US005373691A

United States Patent [19]

Gardner et al.

[11] Patent Number: 5,373,691

[45] Date of Patent: Dec. 20, 1994

[54] INLET GUIDE VANE DEWHISTLER

[75] Inventors: James R. Gardner, Gilbert; William L. Wright; Joseph W. Hough, both of Phoenix, all of Ariz.

[73] Assignee: Allied Signal Inc., Morris Township, Morris County, N.J.

[21] Appl. No.: 81,772

[22] Filed: Jun. 23, 1993

[51] Int. Cl.[5] ..... F04D 21/66

[52] U.S. Cl. ..... 60/39.02; 60/726; 415/119; 415/163

[58] Field of Search ..... 60/39.02, 726; 415/119, 415/161, 163, 164, DIG. 1

[56] References Cited

U.S. PATENT DOCUMENTS

| | | | |
|---|---|---|---|
| 2,171,342 | 6/1939 | McMahan . | |
| 2,440,825 | 5/1948 | Jandasek . | |
| 2,518,869 | 8/1950 | Corless . | |
| 2,739,709 | 3/1956 | Kaiser . | |
| 2,773,553 | 12/1956 | Heurich et al. . | |
| 2,976,952 | 3/1961 | Holland, Jr. . | |
| 3,085,741 | 5/1963 | Burkhardt . | |
| 3,093,299 | 6/1963 | Hamman et al. . | |
| 3,221,983 | 12/1965 | Trickler et al. . | |
| 3,367,273 | 2/1968 | Dodson . | |
| 3,400,902 | 9/1968 | King . | |
| 3,642,379 | 2/1972 | Swearingen . | |
| 3,678,285 | 7/1972 | Griffith . | |
| 3,819,008 | 6/1974 | Evans et al. . | |
| 3,873,231 | 3/1975 | Callahan . | |
| 3,879,939 | 4/1975 | Markowski . | |
| 4,131,134 | 12/1978 | Lindberg . | |
| 4,300,656 | 11/1981 | Burcham . | |
| 4,436,481 | 3/1984 | Linder | 415/119 |
| 4,439,104 | 3/1984 | Edmonds | 415/119 |
| 4,531,356 | 7/1985 | Linder | 415/119 |
| 4,844,695 | 7/1989 | Banks et al. | 415/119 |

FOREIGN PATENT DOCUMENTS

| | | |
|---|---|---|
| 1161481 | 1/1964 | Germany . |
| 293236 | 7/1928 | United Kingdom . |
| 366257 | 2/1932 | United Kingdom . |
| 1120240 | 7/1968 | United Kingdom . |
| 1206307 | 9/1970 | United Kingdom . |
| 1244292 | 8/1971 | United Kingdom . |
| 1307867 | 2/1973 | United Kingdom . |
| 1432262 | 4/1976 | United Kingdom . |

*Primary Examiner*—Louis J. Casaregola
*Attorney, Agent, or Firm*—Jerry J. Holden; James W. McFarland; Robert A. Walsh

[57] ABSTRACT

A method and apparatus for eliminating vortex whistle noise in a radial-to-axial compressor intake uses a plurality of vortex-disturbing tabs mounted to the trailing edges of inlet guide vanes and extending into the flow path between adjacent vanes. The tabs are mounted to the guide vane so that the tab is always perpendicular to the guide vane, regardless of the vanes angular position.

7 Claims, 2 Drawing Sheets

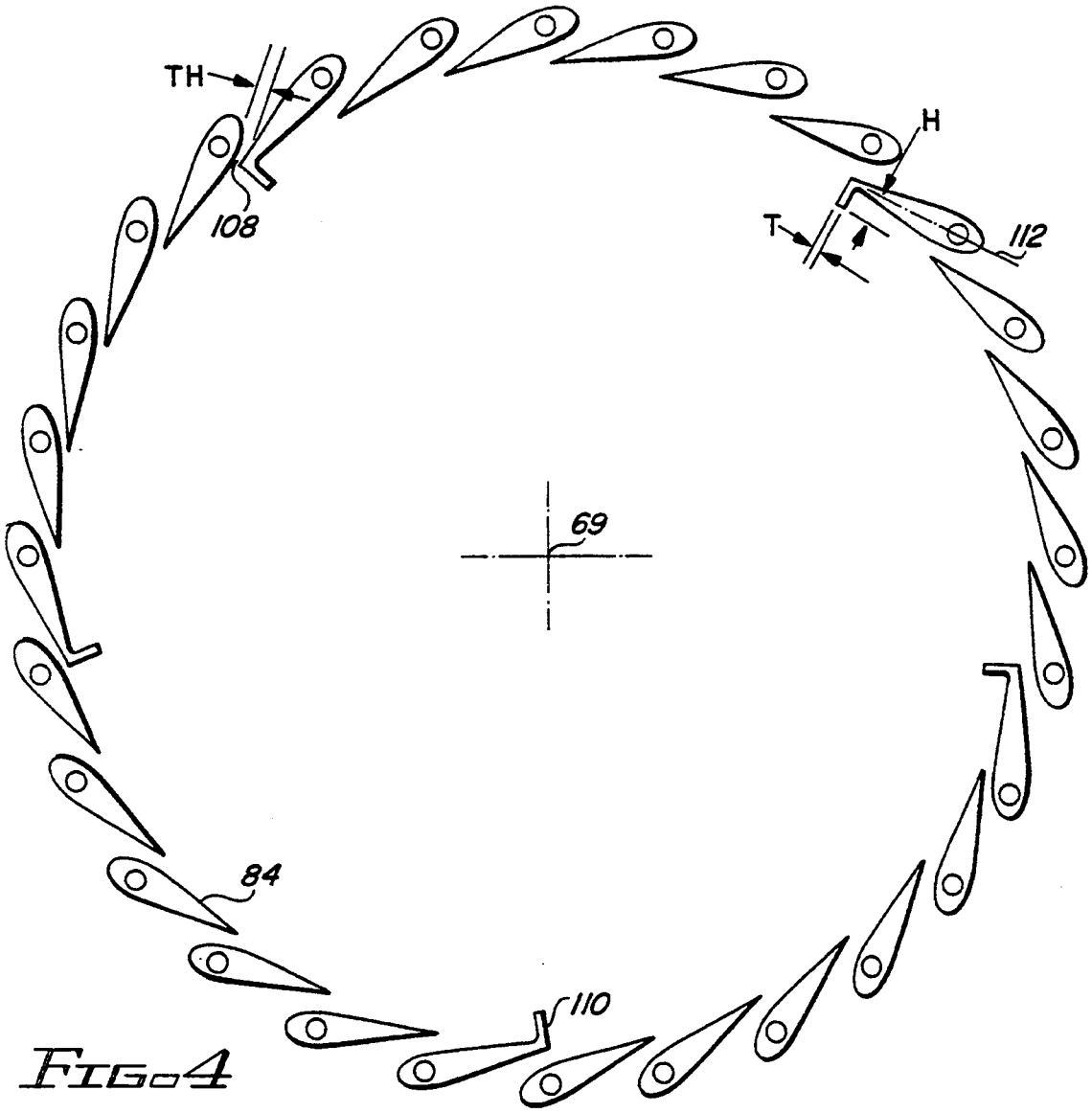
FIG. 4
FIG. 6
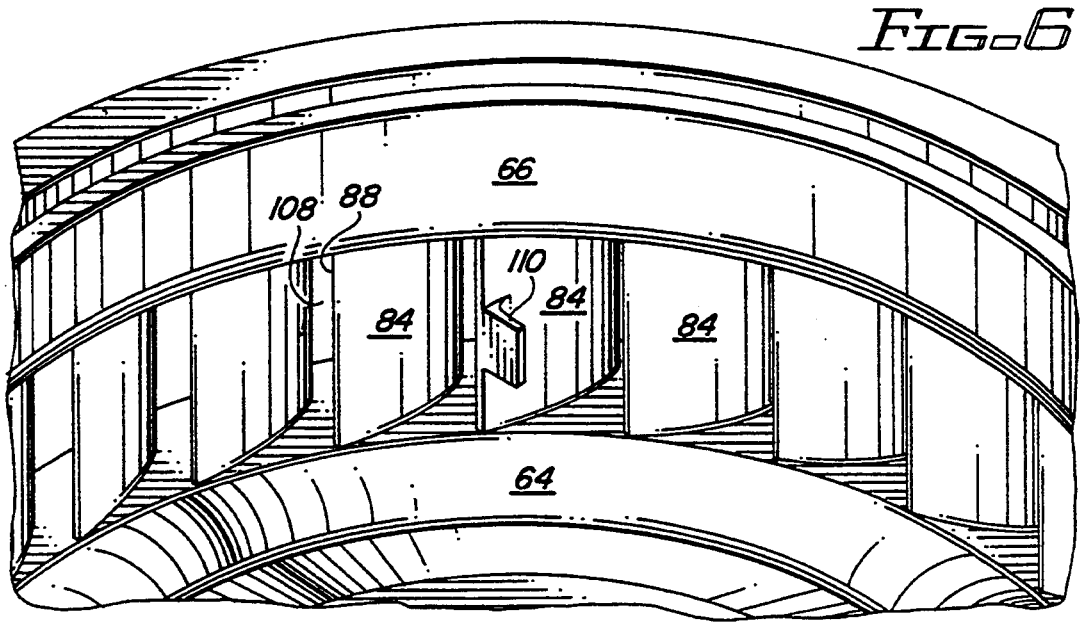

INLET GUIDE VANE DEWHISTLER

TECHNICAL FIELD

This invention relates generally to noise-attenuating devices, and more particularly to a novel apparatus and methods for silencing vortex "whistle" noises generated within the radial-to-axial intake section of the load compressor of a gas turbine engine auxiliary power unit.

BACKGROUND OF THE INVENTION

In addition to their traditional propulsion functions, gas turbine engines are also used aboard aircraft as auxiliary power units (APU) to supply pneumatic power to a wide variety of accessory devices and systems. This is accomplished by bleeding a desired quantity of compressed air from a centrifugal "load" compressor which is connected to and driven by the engine's drive shaft.

Ambient air is drawn axially into the load compressor through the annular flow passage of an intake assembly which has a circular, radially outwardly facing inlet opening that circumscribes the drive shaft. Adjustable inlet guide vanes are mounted in a mutually spaced relationship around the circumference of the radial inlet opening for conjoint pivotal motion about axes parallel to the shaft axis between a fully closed position, in which the vanes are each generally tangentially disposed relative to their inlet opening, and a fully open position in which each of the vanes extends generally radially inwardly therefrom. By selectively adjusting the angular position of these vanes the flow rate of air entering the load compressor (and thus the flow rate of compressed air supplied to the pneumatically-operated accessory apparatus) during engine operation may be accurately regulated.

Because of their orientation relative to the drive shaft axis, the inlet guide vanes, within a certain range of opening angles, impart to air traversing the intake assembly flow passage a desirable vortex pattern in which the air swirls about the shaft axis as it is drawn axially into the load compressor. This vortex pattern causes the air therein to contact the curved impeller blades of the centrifugal load compressor at an efficient angle of incidence.

However, in conventional radial-to-axial air intake assemblies of the type described, the induced air swirl also creates, at certain inlet guide vane angles, a shrill intake noise known as vortex whistle or the Ranque-Hilsch effect. Vortex whistle is undesirable from two standpoints. First, it is often unacceptable under applicable acoustic standards. Second, generation of the whistle within the intake assembly causes an aerodynamic energy loss which diminishes the efficiency of the load compressor.

U.S. Pat. No. 4,844,695 discloses one approach for attenuating or eliminating vortex whistle in a centrifugal compressor inlet. This approach employs a plurality of flow fences disposed along the radially inner wall between the inlet guide vanes and the compressor and extending into the flow path. These fences apparently attenuate the vortex whistle by disrupting a portion of the swirling air flow generated by the inlet guide vanes.

Another approach to attenuating vortex whistle is disclosed in U.S. Pat. Nos. 4,436,481, 4,439,104, and 4,531,356 which are assigned to the assignee of this application. With this approach, elongated tabs are mounted on a pair if diametrically opposed inlet guide vanes. The tabs are rotatably mounted to the leading edges of the guide vanes. As the vanes close, the tabs extend into the flow path where they create small zones of random turbulence which attenuate the vortex whistle. Though this approach has been successfully used on numerous engines, on some engines it has been discovered that the insertion of the elongated tabs into the flow path altered the inlet guide vane angle at which the vortex whistle occurred.

Accordingly, there is a need for an apparatus and method that eliminates or minimizes vortex whistle regardless of the inlet guide vane angle.

SUMMARY OF THE INVENTION

An object of the present invention is to provide an apparatus to be mounted on an inlet guide vane that eliminates or attenuates vortex whistle regardless of the inlet guide vane angle.

Another object of the present invention is to provide an apparatus mounted to an inlet guide vane that attenuate vortex whistle and rotates with the guide vane so that it is always perpendicular to the guide vane.

The present invention achieves these objectives by providing a tab fixed to the trailing edge of an inlet guide vane and extending perpendicular therefrom. As air passes across the inlet guide vane, the tab generates turbulence in much the same way as a spoiler on an aircraft wing. The turbulence disrupts the Hilsch-Ranque effect which attenuate the vortex whistle, without affecting the incidence angle of the air on the impeller blades downstream.

BRIEF DESCRIPTION OF THE DRAWINGS

FIG. 4 is a schematic representation showing the circumferential disposition of the inlet guide vanes of FIG. 1.

FIG. 6 is a perspective view, looking radially outward, of a portion of the load compressor intake assembly of FIG. 1.

DESCRIPTION OF THE PREFERRED EMBODIMENT

Figure 1:
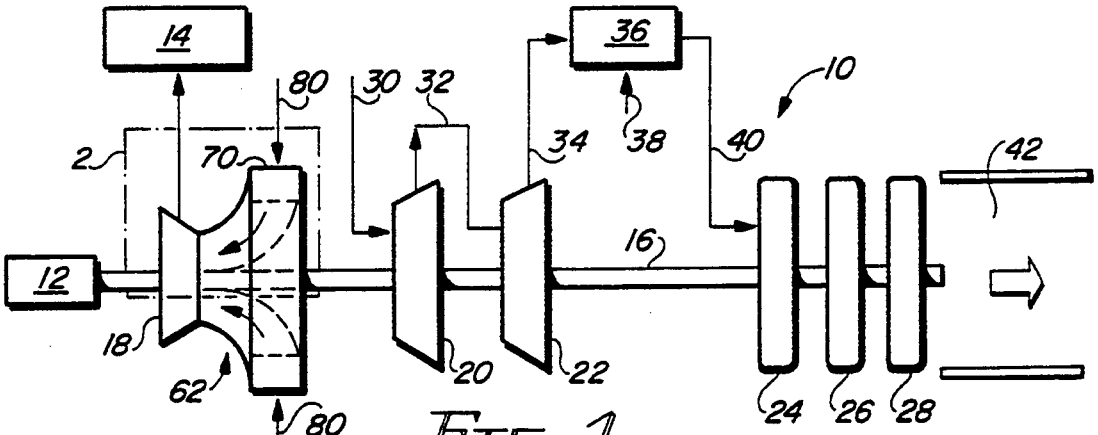
FIG. 1 is a schematic diagram of a gas turbine engine auxiliary power unit (APU) with a load compressor intake assembly with inlet guide vanes having the vortex whistle silencing apparatus contemplated by the present invention.

A gas turbine engine auxiliary power unit (APU) 10 is schematically illustrated in FIG. 1. Auxiliary power units such as APU 10 are typically used to provide mechanical power to a driven accessory such as a generator 12, and to simultaneously supply compressed air to an accessory system such as an aircraft environmental control system 14 or to other pneumatically-operated devices such as air turbine motors and the like.

APU 10 includes a power shaft 16 drivingly coupled as its left end (through a gearbox not shown in FIG. 1) to the generator 12. Fixedly mounted on shaft 16 for rotation therewith are, from left to right along its length, a centrifugal load compressor 18, first and second stage centrifugal power compressor 20, 22, and first second and third stage axial power turbines 24, 26 and 28, positioned at the right end of shaft 16.

During operation of the APU, ambient air 30 is drawn into the inlet of the first stage power compressor 20, compressed, and then discharged through a duct 32 into the inlet of the second stage power compressor 22 where it is further compressed. Compressor 22 discharges the further compressed air through a duct 34 into a combustor 36. The compressed air entering combustor 36 is mixed with fuel 38 also supplied to the combustor to form a fuel-air mixture which is continuously burned therein. Expanded gas 40 exiting the combustor is forced axially through the power turbines 24, 26, 28 to supply rotational power to the shaft 16 and is exhausted from the APU to atmosphere through a discharge passage 42 positioned immediately downstream of the power turbines. The rotation of the shaft 16 drives the generator 12 (or other mechanically-driven accessories) and also rotationally drives the load compressor 18 which is used to supply compressed air via conduit means 44 to the pneumatically-operated accessory system 14.

Figure 2:
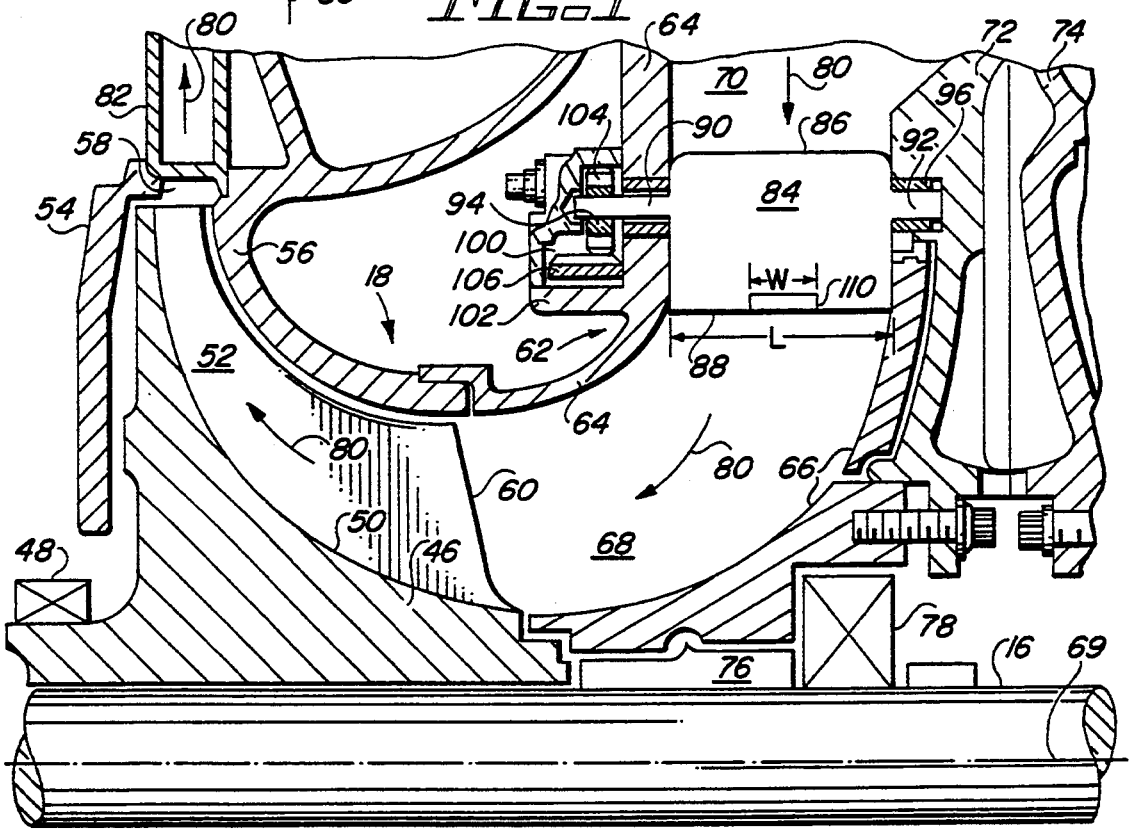
FIG. 2 is an enlarged, fragmentary cross-sectional view through the load compressor portion of the APU within the phantom line envelope 2 of FIG. 1.

As can best be seen in FIG. 2, the load compressor 18 includes a centrifugal hub portion 46 which circumscribes and is fixed to the shaft 16, and is rotatably supported around its left end by bearing means 48. Secured to the hub 46 around its curved periphery 50 are a series of curved impeller blades 52. Hub 46 and blades 52 are enclosed within shroud means having a first wall portion 54 adjacent the left end of hub 46, and a second wall portion 56 spaced axially inwardly of wall 54 and defining therewith a circumferentially extending shroud outlet passage 58 at the radially outermost ends of the impeller blades 52. Shroud wall 56 defines with the hub periphery 50 an axially facing annular inlet 60 of the load compressor 18.

Secured to the load compressor 18 around its inlet 60 is an intake assembly 62 having a hollow, generally bell-shaped body defined by mutually spaced curved wall sections 64, 66 which circumscribe the shaft 16 and in turn define a curved, annular gas flow passage 68 extending through the intake body and communicating at its left or discharge end with the annular load compressor inlet 60. The axis 69 of shaft 16 defines the longitudinal axis of the flow passage.

Wall 64 is sealed at its inner end around the shroud wall 56 adjacent compressor inlet opening 60, and wall 66 is sealed at its inner end around the hub 46 adjacent inlet opening 60. From their connections to the load compressor 18, walls 64, 66 flare rightwardly and radially outwardly, defining at their outer ends a circular, radially outwardly facing inlet opening 70 which communicates with the intake assembly flow passage 68. Intake wall 66 is secured to an annular mounting plate 72 which is in turn secured to a portion 74 of the housing structure of the first stage power compressor 20. Bearings 76, 78 are secured around a central portion of the intake wall section 66 and rotatably support the shaft 16.

During operation of the APU 10, ambient air 80 is drawn into the radially outwardly facing, circular inlet opening 70 of the intake assembly 62 around its entire periphery, traverses the curved, radial-to-axial intake flow passage 68, axially enters the annular load compressor inlet 60, and is then radially discharged by the impeller blades 52 into the annular shroud outlet passage 58. The discharged air then flows into an annular diffuser section 82 circumscribing the passage 58. From the diffuser section the air 80 is discharged into the supply conduit means 44, (see FIG. 1), for delivery to the accessory system 14.

To regulate the quantity of air delivered to the accessory system 14 from the load compressor 18, a series of adjustable inlet guide vanes 84 are incorporated into the intake assembly 62. Referring now to FIGS. 2 and 4, the vanes 84 are positioned in a circumferentially spaced array around the inlet opening 70 of the intake assembly 62. Each of the vanes 84 is aerodynamically configured and has a rounded leading or upstream edge 86 and a thin rounded trailing or downstream edge 88.

Inward from the leading edge 86, each vane 84 is secured to the spaced apart intake walls 64, 66 by means of cylindrical pin 90, 92 (FIG. 2) extending outwardly from the opposite ends of each vane 84. The pins 90, 92 are rotatably received in bearings 94, 96 respectively carried by the intake wall sections 64, 66. This permits pivotal motion of the vanes 84 about an axis parallel to the axis 69 of shaft 16. The vanes 84 can rotate from a fully open position with the trailing edges 88 extending generally radially into the flow passage 68, referred to as zero degree vane angle, to fully closed position at which the trailing edges 88 are generally tangentially disposed relative to the outer circumference of the intake assembly 62, referred to as ninety degree vane angle.

The pins 90 extend into an annular chamber 100 formed within a circumferentially extending, axially enlarged portion 102 of intake wall section 64. Within the chamber 100 are a series of small segmented spur gears 104, each of which is keyed to one of the pins 90. Each of the gears 104 engages a ring gear 106 which is also located within the chamber 100. The vanes 84 are conjointly pivoted to open and close the opening or channel 108, (FIG. 6),between adjacent vanes. In a conventional manner, (by means not shown), the ring gear 106 is related, thereby simultaneously rotating all of the other spur gears 104 and the vanes 84 to which they are secured.

Figure 3:
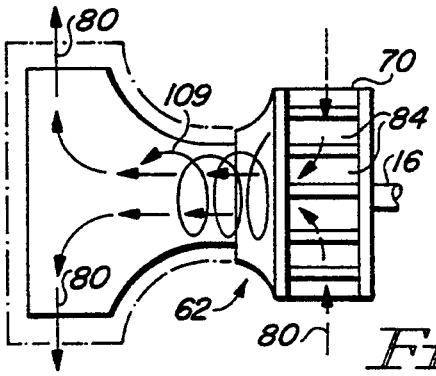
FIG. 3 is a schematic representation of the load compressor and intake assembly portion of FIG. 1 illustrating the air flow therethrough.

The use of the guide vanes 84 in the described orientation permits the indicated compact structural arrangement of the APU in which the load compressor 18 is positioned directly adjacent the power compressor 20. Additionally, because of such orientation, air entering the intake assembly inlet opening 70 has imparted thereto a vortex air pattern 109 (FIG. 3) which causes it to swirl about the shaft axis 69 as it inwardly traverses the intake flow passage 68. This swirling air pattern causes the incoming air to interact with the impeller blades 52 at an efficient incidence angle.

Figure 5:
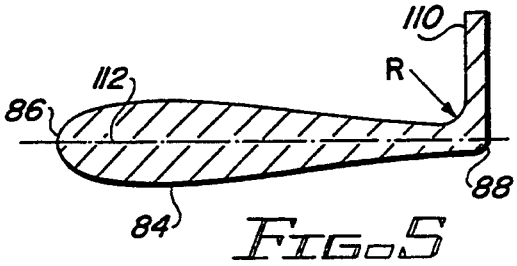
FIG. 5 is a cross-sectional view of an inlet guide vane of FIG. 1.

Referring now to FIGS. 4, 5, and 6, the present invention achieves the desired attenuation of the vortex whistle by the unique use of a tab 110 mounted to the trailing edge 88 of some of the inlet guide vanes 84. The tab 110 is a thin plate preferably having sharp edges. In the preferred embodiment, the vane 84 and the tab 110 are machined from a single piece of aluminum stock. Alternatively, the tab 110 can be attached to the vane 84 either by welding or by some mechanical means such as metal clip. The tab 110 is perpendicular to the chord line 112 of the vane 84, and extends radially inward toward the centerline 69. The minimum height H of the tab 110 is preferably about 25 percent of the width of the channel 108, represented by the symbol TH, when the vanes are at a 60 degree vane angle. The ratio of the width, W, of the tab 110 to the length, L, of the trailing edge 88 should be about 1/5. Also, the radius R should be no larger than half the height H. At a minimum, the axial centerline of the tab 110 should be at least ¼ the length L from the either of the walls 64 or 66. Defining the leading edge 86 as the 0 percent point and the trailing edge 88 as the 100 percent point, the tab 110 is preferably located within the rear 25 percent of the vane 84. Lastly, the thickness of the tab 110 is selected to withstand any aerodynamic loads.

Referring to FIG. 4, the tabs 110 are located on five, unequally spaced vanes 84. This number may vary depending on the particular geometry of the intake assembly 62. However, it is important in selecting which vanes receive a tab to be sure that they are properly spaced so has not to induce strains on the impeller blades 52 downstream. Techniques for determining the proper spacing are well known in the art.

In operation the tab 110 acts much like a spoiler on the wing of an aircraft. Because the tab 110 rotates with the inlet guide vane 84, it always remains perpendicular to the direction of swirl of the incoming air, and as a result generates the maximum blockage and turbulence, especially at inlet guide vane angles of 60 degrees to 70 degrees. This turbulence disrupts the Hilsch-Ranque effect reducing and eliminating the vortex whistle, without affecting the incidence angle of the air on the impeller blades 52.

Various modifications and alterations to the above described preferred embodiment will be apparent to those skilled in the art. Accordingly, this description of the invention should be considered exemplary and not as limiting to the scope and spirit of the invention as set forth in the following claims.

What is claimed is:

1. A variable flow rate intake apparatus adapted for connection to a gas-utilizing device having an annular inlet opening, said intake apparatus having an axis and comprising:

(a) a first and second mutually spaced, concentric walls circumscribing said axis and defining therebetween a gas flow passage having a generally axially facing annular outlet and a generally radially outwardly facing inlet encircling said axis;

(b) a circumferentially spaced plurality of adjustable inlet guide vanes extending between and carried by said walls around said flow passage inlet for pivotal motion about axes generally parallel to said axis of said intake apparatus, said guide vanes being operable to vary the flow rate of gas entering said inlet and to cause the entering gas to assume a vortex pattern as it passes through said flow passage; and (c) at least one tab extending from at least one of said inlet guide vanes into said flow passage, said tab being attached to said inlet guide vane substantially near the trailing edge of said inlet guide vane.

2. The apparatus of claim 1 wherein said tab is substantially perpendicular to said vane.

3. The apparatus of claim 2 wherein said tab is fixed to said vane so that said tab maintains its perpendicularity with said vane as said vane rotates.

4. A gas turbine engine comprising:

(a) a first compressor;

(b) a combustor for receiving compressed air discharged from said first compressor, mixing the received air with fuel, burning the fuel-air mixture to form a hot, pressurized gas;

(c) a turbine, drivingly coupled to said first compressor, receiving said hot gas from said combustor and converting the thermal energy of said gas into mechanical power;

(d) a second compressor, drivingly coupled to said turbine, for supplying compressed air to pneumatically-operated apparatus;

(e) an air inlet for directing a flow of ambient air into said second compressor;

(f) a plurality of inlet guide vanes rotatably mounted in said air inlet; and (g) at least one tab extending from at least one of said inlet guide vanes into said flow of ambient air, said tab being attached to said inlet guide vane substantially near the trailing edge of said inlet guide vane.

5. The apparatus of claim 4 wherein said tab is substantially perpendicular to said vane.

6. The apparatus of claim 5 wherein said tab is attached to said vane so that said tab maintains its perpendicularity with said vane rotates.

7. A method of attenuating vortex whistle noise in a gas intake device having an axis, a generally radially outwardly facing inlet opening circumscribing the axis, a gas flow passage communicating with the inlet opening and having a generally axially facing discharge end, and a circumferentially spaced series of rotatable inlet guide vanes positioned around the inlet opening for causing gas entering the inlet opening to swirl about the axis in a vortex flow pattern circumscribing the axis as the gas traverses the flow passage, said method comprising the steps of:

(a) providing at least one vortex-disturbing member adapted to intercept a portion of the vortex flow pattern within the flow passage for significantly disrupting said gas flow as it traverses said inlet guide vanes;

(b) securing said vortex-disturbing member to one of said inlet guide vanes so that said vortex-disturbing member is perpendicular to said guide vane and extends into a portion of said flow passage; and (c) rotating said guide vanes while maintaining said vortex-disturbing member perpendicular to said inlet guide vane to which it is secured.

* * * * *